United States Patent [19]

Mitchell

[11] 4,306,537

[45] Dec. 22, 1981

[54] GAS FIRE

[76] Inventor: Douglas A. Mitchell, 7, Clifton Gardens, Eaglescliffe, Stockton-on-Tees, Cleveland, England

[21] Appl. No.: 59,949

[22] Filed: Jul. 23, 1979

[30] Foreign Application Priority Data

Jul. 21, 1978 [GB] United Kingdom ..... 30680/78

[51] Int. Cl.[3] ..... F24C 3/04

[52] U.S. Cl. ..... 126/92 AC; 431/125

[58] Field of Search ..... 126/92 AC, 92 R, 208, 126/400, 39 J, 127, 165; 438/328, 326, 347, 125; 239/211; 431/110, 125, 113, 326

[56] References Cited

U.S. PATENT DOCUMENTS

| | | | |
|---|---|---|---|
| 334,877 | 1/1886 | MacKusick | 126/92 R |
| 1,869,763 | 8/1932 | McFadden | 126/92 AC |
| 3,362,395 | 1/1968 | Peterson | 126/127 X |
| 3,362,395 | 1/1968 | Peterson | 126/92 R |
| 3,385,651 | 6/1968 | Rasmussen et al. | 126/92 R |
| 3,543,741 | 12/1970 | Whitehead | 126/92 R |
| 3,582,250 | 6/1971 | Chatfield | 431/125 |
| 3,583,845 | 6/1971 | Pulone | 431/125 |
| 3,671,175 | 6/1972 | Campbell | 126/92 R X |
| 3,696,801 | 10/1972 | Whitehead | 126/92 R |
| 3,747,585 | 7/1973 | Coats | 126/92 R |
| 3,947,229 | 3/1976 | Richter | 126/92 R X |
| 4,110,063 | 8/1978 | Mitchell | 126/328 X |

FOREIGN PATENT DOCUMENTS

| | | | |
|---|---|---|---|
| 413521 | 7/1934 | United Kingdom | 126/92 AC |
| 465290 | 5/1937 | United Kingdom | 126/127 |

*Primary Examiner*—Samuel Scott
*Assistant Examiner*—Randall L. Green
*Attorney, Agent, or Firm*—Schwartz & Weinrieb

[57] ABSTRACT

A solid-fuel effect gas fire comprises an open-topped tray containing a mass of particulate refractory material, means for introducing gas into the tray to percolate upwards to the surface of the refractory material, an apertured or porous plate overlying, but spaced from, part of the surface of the particulate material, and a plurality of refractory bodies, shaped and colored to simulate solid fuel, heaped on the plate and the part of the tray which is not covered by the plate. In use, the fire operates with a mixture of luminous and non-luminous flames and closely resembles a conventional solid-fuel fire. The ratio of carbon dioxide to carbon monoxide in the gases of combustion is from 1:0.01 to 1:0.005.

8 Claims, 3 Drawing Figures

GAS FIRE

FIELD OF THE INVENTION

This invention relates to heating appliances which burn gaseous fuel but which simulate solid-fuel fires. In this specification such appliances are referred to as solid-fuel effect gas fires.

BACKGROUND OF THE INVENTION

In my British patent specification No. 1541423, which corresponds to U.S. Pat. No. 4110063, there is described such a solid-fuel effect gas fire which comprises a mass of particulate refractory material in an open-topped tray, a plurality of refractory bodies, shaped and coloured to simulate solid fuel, arranged in a heap on the top of the particulate refractory material, means for supplying a gaseous fuel into the mass of particulate refractory material so that the gaseous fuel percolates upwardly through the mass of particulate refractory material into spaces between the bodies, and at least one air passage for providing extra combustion air to the gaseous fuel flowing to only some of the spaces between the bodies so that, in use, the gaseous fuel provided with the extra combustion air from said passage burns with a non-luminous flame and that without the extra combustion air burns with a luminous flame thereby realistically simulating a solid-fuel effect fire.

In use, I have found that the appearance of these fires is very realistic and from a distance it is difficult to determine whether or not the fire is a solid-fuel fire. This is due to the fact that, when the gas fire is in operation, the gas burns to produce both luminous and non-luminous flames, as are present in a solid-fuel fire.

I have found that, in use, the gases of combustion of the previously described solid-fuel effect gas fire have a $CO_2$ to CO ratio of between 1:0.02 and 1:0.01. Clearly the operating combustion efficiency of the fire would be improved if this ratio of $CO_2$ to CO could be changed to reduce the CO level still further. An increase in combustion efficiency would result in flames of still higher temperature and this would lead either to a greater heat output from the fire for the same quantity of gaseous fuel or the same heat output could be obtained with a reduction in the gaseous fuel which is used.

OBJECTS OF THE INVENTION

It is an object of the present invention to provide a solid-fuel effect gas fire in which the combustion efficiency is improved as compared with known solid-fuel effect gas fires.

SUMMARY OF THE INVENTION

According to the present invention, a solid-fuel effect gas fire comprises an open-topped tray containing a mass of particulate refractory material, means for introducing gaseous fuel into the mass of particulate material such that the gas percolates upwardly through the mass of particulate material, a porous or apertured plate overlying part of the surface of the particulate refractory material in the tray and spaced apart therefrom, means for introducing combustion air into the space between the plate and the surface of the particulate refractory material, and a plurality of refractory bodies shaped and coloured to simulate solid fuel arranged in a heap on the metal plate and on the part of the tray which is not covered by the plate.

In use, gaseous fuel is fed into the mass of particulate material where it is distributed by the particles and leaves the tray from substantially the entire upper surface of the mass of particulate material. That portion of the gas leaving the tray beneath the plate enters into the space between the tray and the plate where it mixes with the combustion air, and the air/gas mixture passes through the pores or apertures in the plate. These pores or apertures form burner ports where the air/gas mixture burns as a series of short high-temperature flames. The hot combustion gases from these flames flow into the spaces between the refractory bodies positioned above the plate and heat these bodies to a bright red heat. The gas which enters the spaces between those bodies, heaped on the part of the tray not covered by the plate, burns with luminous flames which raise the temperature of the refractory bodies licked by them to a certain degree but any gas/air mixture burns with flames of a much higher temperature and causes those refractory bodies which are licked by the flames to be heated to a higher temperature. Consequently, the effect is that some of the refractory bodies glow to a greater extent than the others and the appearance of the fire is even more similar to that of a conventional solid fuel fire.

That part of the gas which is mixed with air, before it is burnt, burns with a higher combustion efficiency than that which burns with luminous flames. The maximum combustion efficiency would be obtained if all the gas was mixed with air before it was burnt, but this would provide only non-luminous flames and the appearance of the fire would not be realistic of a solid-fuel fire which burns with both luminous and non-luminous flames. I have found that, if approximately half of the surface of the particulate material in the tray is covered by the plate, so that approximately half of the gaseous fuel supplied to the fire is mixed with air before being burnt, then the appearance of the fire is most realistic. The ratio of $CO_2$ to CO in the products of combustion of such a fire is then of the order of 1:0.01 to 1:0.005.

BRIEF DESCRIPTION OF THE DRAWINGS

In order that the invention may be more readily understood it will now be described, by way of example only, with reference to the accompanying drawings, in which:-

DETAILED DESCRIPTION OF THE ILLUSTRATED EMBODIMENT

Figure 1:
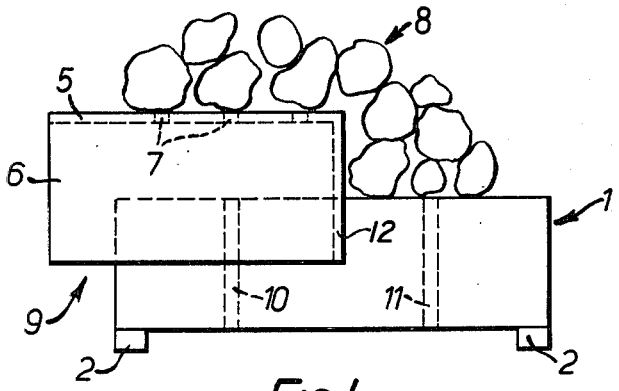
FIG. 1 is a diagrammatic side elevation of a soid-fuel effect gas fire.
Figure 2:
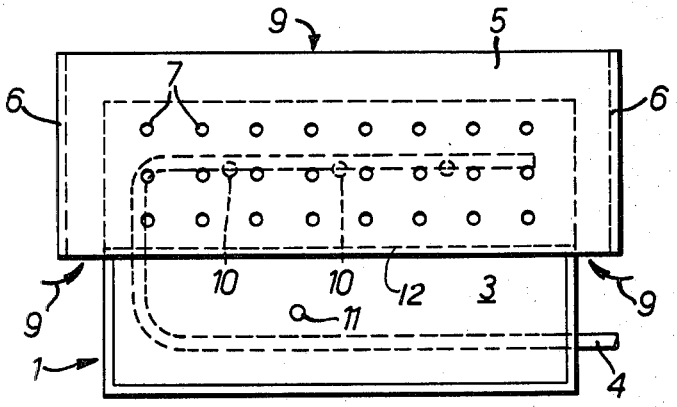
FIG. 2 is a plan of the fire of FIG. 1 with the simulated solid fuel omitted.
Figure 3:
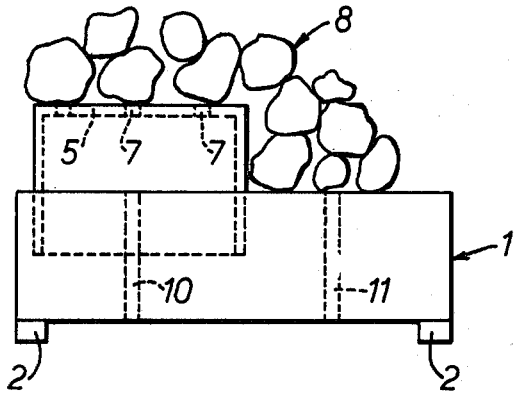
FIG. 3 is a view similar to that of FIG. 1, showing, however, another embodiment of the present invention.

A solid-fuel effect gas fire comprises a metal open-topped tray 1 standing on feet 2. A mass of particulate refractory material 3, such as sand, is contained in the tray. A gas pipe 4 leads into the tray and is buried in the particulate material. Gas fed into the pipe enters the mass of particulate material and is distributed by the material so that it issues more or less uniformly from the upper surface of the material in the tray.

A plate has a central portion 5 which overlies about half of the surface of the material in the tray and two downwardly extending end portions 6 which are at right angles to the central portion. The plate is secured to the tray 1 by means not shown, so that the central portion 5 is spaced above the upper surface of the material in the tray 1 and the portions 6 are spaced from the side of the tray. A downwardly depending front portion 12 of the plate is buried at its lower end in the mass of particulate refractory material in the tray. A plurality of small apertures 7 are provided in the central portion 5 of the plate. Refractory bodies 8, shaped and coloured to simulate solid fuel such as coal, are placed in a heap so as to overlie the apertures in the plate and that part of the upper surface of the tray 1 which is not covered by the plate.

When gas is supplied to the gas pipe 4, it is distributed over the upper surface of the particles in the tray and some enters into the spaces between the bodies 8. The gas leaving the surface of the material in the tray, which is beneath the plate, enters into the space between the surface and the plate where it mixes with air entering the space from the back and ends of the plate, as indicated by the arrows 9. The air/gas mixture then passes through the apertures 7 and burns as it issues from these apertures.

As a preferred arrangement, air is also directed into the space between the upper surface of the refractory particulate material in the tray and the lower side of the plate through one or more tubes 10 which extend into the space from beneath the tray.

The gas leaving the surface of the mass of particulate material in the tray, which is not covered by the plate, enters into the spaces between those bodies 8 which are immediately above it.

This gas burns with a luminous flame and the gas/air mixture burns with a much hotter flame, thereby causing some of the refractory bodies to glow to a greater extent than the others. By arranging for the hotter flames to be at the rear of the fire, the heat generated by these flames may be used with advantage to heat, by radiation, air in a convector chamber (not shown) positioned at the rear of the fire.

The size of the apertures in the plate, for example 0.1–4 mm diameter, are such as to prevent, at low rates of gas flow, flames striking back into the space beneath the plate.

One or more tubes 11 may extend from beneath the tray, through the tray to that part of the surface thereof which is not covered by the plate 5. This allows combustion air to be provided to some of the gas which flows to the spaces between the bodies arranged on the part of the tray which is not covered by the plate 5.

By supplying excess combustion air to a large proportion of the gas which is supplied to the tube 4, the amount of carbon monoxide which is present in the gases of combustion is reduced, so that the ratio of carbon dioxide to carbon monoxide in the gases of combustion is within the range 1:0.01 to 1:0.005.

The plate 5 could be a permeable ceramic material or a porous sintered metal.

In an alternative arrangement, the length of the plate 5 is less than the corresponding dimension of the tray 1 so that the plate is fitted within the tray with the downwardly depending parts of the plate buried at their lower ends in the mass of particulate refractory material in the tray. In this arrangement, air enters into the space between the plate and the upper surface of the mass of particulate refractory material by way of the opening at the back of the plate and by way of the tubes 10.

Obviously, many modifications and variations are possible in light of the foregoing teachings. It is therefore to be understood that within the scope of the accompanying claims, the present invention may be practiced otherwise than as specifically described herein.

I claim:

1. A solid-fuel effect gas fire, comprising:

an open-topped tray containing a mass of particulate refractory material;

a porous or apertured plate disposed relative to said tray so as to be spaced from and overlie part of the surface of said particulate refractory material disposed within said tray;

means for introducing gaseous fuel into said mass of particulate refractory material such that said gas percolates upwardly through said mass of particulate refractory material to said surface thereof whereby a first portion of said gas issuing from the part of said particulate refractory material which is not covered by said plate will burn with a luminous flame, while a second portion of said gas issuing from the part of said particulate refractory material which is covered by said plate will enter into said space defined between said plate and said surface of said particulate refractory material;

means for introducing combustion air into said space defined between said plate and said surface of said particulate refractory material so as to mix with said second portion of said gas whereby said mixture of said second portion of said gas and said combustion air will pass through said apertures within said plate so as to burn with a non-luminous flame; and a plurality of refractory bodies, shaped and colored so as to simulate solid fuel, disposed in a heap upon said plate and the portion of said surface of said particulate refractory material disposed within said tray which is not covered by said plate, whereby said luminous and non-luminous flames burn, and heat said plurality of refractory bodies, so as to create a realistic, simulated, conventional solid-fuel fire.

2. A solid-fuel effect gas fire, as claimed in claim 1, wherein the plate is of porous ceramic.

3. A solid-fuel effect gas fire, as claimed in claim 1, in which the plate is of sintered metal.

4. A solid fuel effect gas fire, as claimed in claim 1, in which the plate overlies approximately half of the surface of the material in the tray.

5. A solid-fuel effect gas fire, as claimed in claim 1 or 4, in which the means for introducing combustion air comprises one or more air spaces leading to the space between the plate and the surface of the particulate refractory material.

6. A solid-fuel effect gas fire, as claimed in claim 5, in which the means for introducing combustion air includes one or more tubes leading from the space between the plate and the surface of the particulate material to an air space outside the tray.

7. A solid-fuel effect gas fire, as claimed in claim 6, in which the plate has downwardly depending front and side portions, and the plate is located so as not to overlie the walls of the tray and the lower edges of the front and side portions are buried in the particulate refractory material.

8. A solid-fuel effect gas fire, as claimed in claim 1 or 4, in which at least one tube extends from an air space outside the tray to the refractory bodies heaped on the tray.

* * * * *